US010808895B2

(12) United States Patent
Gielen

(10) Patent No.: US 10,808,895 B2
(45) Date of Patent: Oct. 20, 2020

(54) ELONGATED FLEXIBLE LIGHTING DEVICE BASED ON SOLID-STATE LIGHTING TECHNOLOGY

(71) Applicant: SIGNIFY HOLDING B.V., Eindhoven (NL)

(72) Inventor: Vincent Stefan David Gielen, Gastel (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/610,137

(22) PCT Filed: Apr. 24, 2018

(86) PCT No.: PCT/EP2018/060464
§ 371 (c)(1),
(2) Date: Nov. 1, 2019

(87) PCT Pub. No.: WO2018/202480
PCT Pub. Date: Nov. 8, 2018

(65) Prior Publication Data

US 2020/0088364 A1 Mar. 19, 2020

(30) Foreign Application Priority Data

May 2, 2017 (EP) ..... 17168906

(51) Int. Cl.
*F21S 4/24* (2016.01)
*H05B 45/48* (2020.01)
*F21Y 115/10* (2016.01)

(52) U.S. Cl.
CPC ..... *F21S 4/24* (2016.01); *H05B 45/48* (2020.01); *F21Y 2115/10* (2016.08)

(58) Field of Classification Search
CPC ..... F21S 4/24; F21S 4/22; F21S 4/20; F21S 4/00; H05B 45/48; H05B 45/44; F21Y 2115/10; F21Y 2107/00; F21Y 2107/30; F21Y 2107/40
See application file for complete search history.

(56) References Cited

U.S. PATENT DOCUMENTS

| | | | | |
|---|---|---|---|---|
| 8,398,258 | B1 | 3/2013 | Gerrish et al. | |
| 2004/0037079 | A1* | 2/2004 | Luk | H05B 45/00 362/249.06 |
| 2004/0095078 | A1 | 5/2004 | Leong et al. | |
| 2005/0162850 | A1 | 7/2005 | Luk et al. | |
| 2010/0164409 | A1 | 7/2010 | Lo et al. | |
| 2014/0184088 | A1 | 7/2014 | Lu et al. | |

(Continued)

FOREIGN PATENT DOCUMENTS

| | | | |
|---|---|---|---|
| CN | 103016999 | B | 4/2013 |
| EP | 2094064 | A1 | 8/2009 |

(Continued)

*Primary Examiner* — Bao Q Truong
(74) *Attorney, Agent, or Firm* — Daniel J. Piotrowski

(57) ABSTRACT

There is presented a lighting device (1) comprising: an elongated flexible core (2) having a polygonal transverse cross section; and a flexible circuit strip (3) having several solid-state lighting elements (4) mounted thereon, the flexible circuit strip (3) being helically wound around the core (2). There is also presented a method for producing such a lighting device (1).

9 Claims, 2 Drawing Sheets

(56) References Cited

U.S. PATENT DOCUMENTS

| | | | | |
|---|---|---|---|---|
| 2015/0062892 | A1 | 3/2015 | Krames et al. | |
| 2016/0356440 | A1* | 12/2016 | Xu | F21V 31/04 |

FOREIGN PATENT DOCUMENTS

| | | | |
|---|---|---|---|
| JP | 2009037795 | A | 2/2009 |
| JP | 2009289724 | A | 12/2009 |
| JP | 2011108424 | A | 6/2011 |
| JP | 5492758 | B2 | 5/2014 |
| JP | 2015153705 | A | 8/2015 |
| WO | 2016063067 | A1 | 4/2016 |

* cited by examiner

ELONGATED FLEXIBLE LIGHTING DEVICE BASED ON SOLID-STATE LIGHTING TECHNOLOGY

CROSS-REFERENCE TO PRIOR APPLICATIONS

This application is the U.S. National Phase application under 35 U.S.C. § 371 of International Application No. PCT/EP2018/060464, filed on Apr. 24, 2018, which claims the benefit of European Patent Application No. 17168906.0, filed on May 2, 2017. These applications are hereby incorporated by reference herein.

FIELD OF THE INVENTION

The present invention relates to an elongated lighting device which is flexible and based on solid-state lighting (SSL) technology.

BACKGROUND OF THE INVENTION

Light-emitting diode (LED) strips formed by a flexible flat substrate with surface-mounted LEDs are widely used in many applications, for example cove lighting, wall washing and other decorative lighting applications. However, a factor that limits their applicability is that they are typically only easily flexible out of the plane of the substrate, the in-plane stiffness of the substrate being too high to allow extensive in-plane bending. Various attempts have been made to provide lighting devices that are easily flexible in several directions, an example being the lighting device disclosed in US 2005/0162850 A1. That lighting device has a flexible cylindrical tube inside which a helically wound LED strip with a stiffening wire is arranged.

Despite the efforts that have gone into developing elongated flexible lighting devices, there exists a need for further technological development aimed at improving, or simply expanding, the state of the art in order to satisfy evolving consumer expectations.

SUMMARY OF THE INVENTION

It is an object of the present invention to provide an improved or alternative elongated flexible lighting device.

According to a first aspect of the invention, there is presented a lighting device comprising: an elongated flexible core having a polygonal transverse cross section; and a flexible circuit strip having several SSL elements mounted thereon, the flexible circuit strip being helically wound around the core.

The present invention is based on the realization that one way of overcoming the problem that flexible circuit strips are generally not flexible in the plane of the strip is to form the circuit strip into a helix and to arrange the helix around a flexible core. The above-described lighting device, which is designed in that way, can be easily and extensively flexible in several directions. The lighting device may for example be adapted so as to be bendable in at least two non-parallel directions. It is also possible to produce the above-described lighting device in a relatively fast, simple and inexpensive manner.

The core greatly facilitates the helical winding of the circuit strip, and the fact that the cross section of the core is polygonal facilitates accurate positioning of the SSL elements and thus the provision of a light distribution that is not omnidirectional. For example, a light distribution that equals the beam angle(s) of the SSL elements is easy to provide using such a core. The cross section of the core may have the shape of a regular or an irregular polygon. Examples of cross sections include, but are not limited to, cross sections that are triangular, rectangular, pentagonal, hexagonal or heptagonal. All of the SSL elements may be arranged on a single longitudinal side of the core. In that way all of the SSL elements may be oriented so that all of them have the same general direction of illumination. Alternatively, the SSL elements may be arranged on several longitudinal sides of the core. In that way the SSL elements may be oriented so that the lighting device is capable of emitting light in several general directions of illumination.

The core may have a modulus of elasticity in the range from 0.001 GPa to 1 GPa, for example from 0.1 GPa to 1 GPa, and/or a yield strength in the range from 5 MPa to 50 MPa, for example from 25 MPa to 50 MPa. The core can for example be made of a plastic material. Examples of core materials include PUR (foam), PVC and silicone.

The lighting device may comprise a flexible light-transmissive housing inside which the core and the flexible circuit strip are arranged. The housing may for example be translucent or transparent. The housing may be adapted to control the light distribution. By combining such a housing with a polygonal core it is possible to control the direction of the light emitted by the lighting device to a particularly high degree. The housing may for example have a lens shape. The housing may have a modulus of elasticity in the range from 0.001 GPa to 1 GPa, for example from 0.1 GPa to 1 GPa, and/or a yield strength in the range from 5 MPa to 50 MPa, for example from 25 MPa to 50 MPa. The housing can for example be made of PVC or silicone.

The lighting device may comprise a first set of connectors which are mounted on the flexible circuit strip and which are adapted for electrically connecting the SSL elements to a power supply. The first set of connectors can be used as aligning features to make sure that the SSL elements are correctly aligned/oriented. The first set of connectors and the SSL elements can be arranged on different sides of the core. The lighting device may comprise a wire which electrically connects the first set of connectors to each other and which extends along a side of the core where the first set of connectors are arranged.

The lighting device may comprise a second set of connectors which are mounted on the flexible circuit strip and which are adapted for electrically connecting the SSL elements to a power supply. Like the connectors of the first set, the connectors of the second set can be used as aligning features. Moreover, the second set of connectors may provide redundancy. The second set of connectors may be arranged on a different side of the core than the first set of connectors and the SSL elements. The lighting device may comprise a wire which electrically connects the second set of connectors to each other and which extends along a side of the core where the second set of connectors are arranged.

According to a second aspect of the invention, there is presented a method for producing a lighting device, the method comprising: providing an elongated flexible core having a polygonal transverse cross section; providing a flexible circuit strip having several SSL elements mounted thereon; and helically winding the flexible circuit strip around the core.

The effects and features of the second aspect of the invention are largely analogous to those described above in connection with the first aspect of the invention The step of helically winding the flexible circuit strip around the core may comprise arranging all of the SSL elements on a single side of the core. Differently stated, the step of helically winding the flexible circuit strip around the core may be performed in such a way that the SSL elements end up being positioned on a single side of the core. Alternatively, the step of helically winding the flexible circuit strip around the core may be performed in such a way that the SSL elements end up being positioned on two or more sides of the core.

The method may comprise: overmolding the flexible circuit strip and the core to form a flexible light-transmissive housing; or inserting the flexible circuit strip and the core into a pre-formed flexible light-transmissive housing. The overmolding can for example be performed by co-extrusion.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
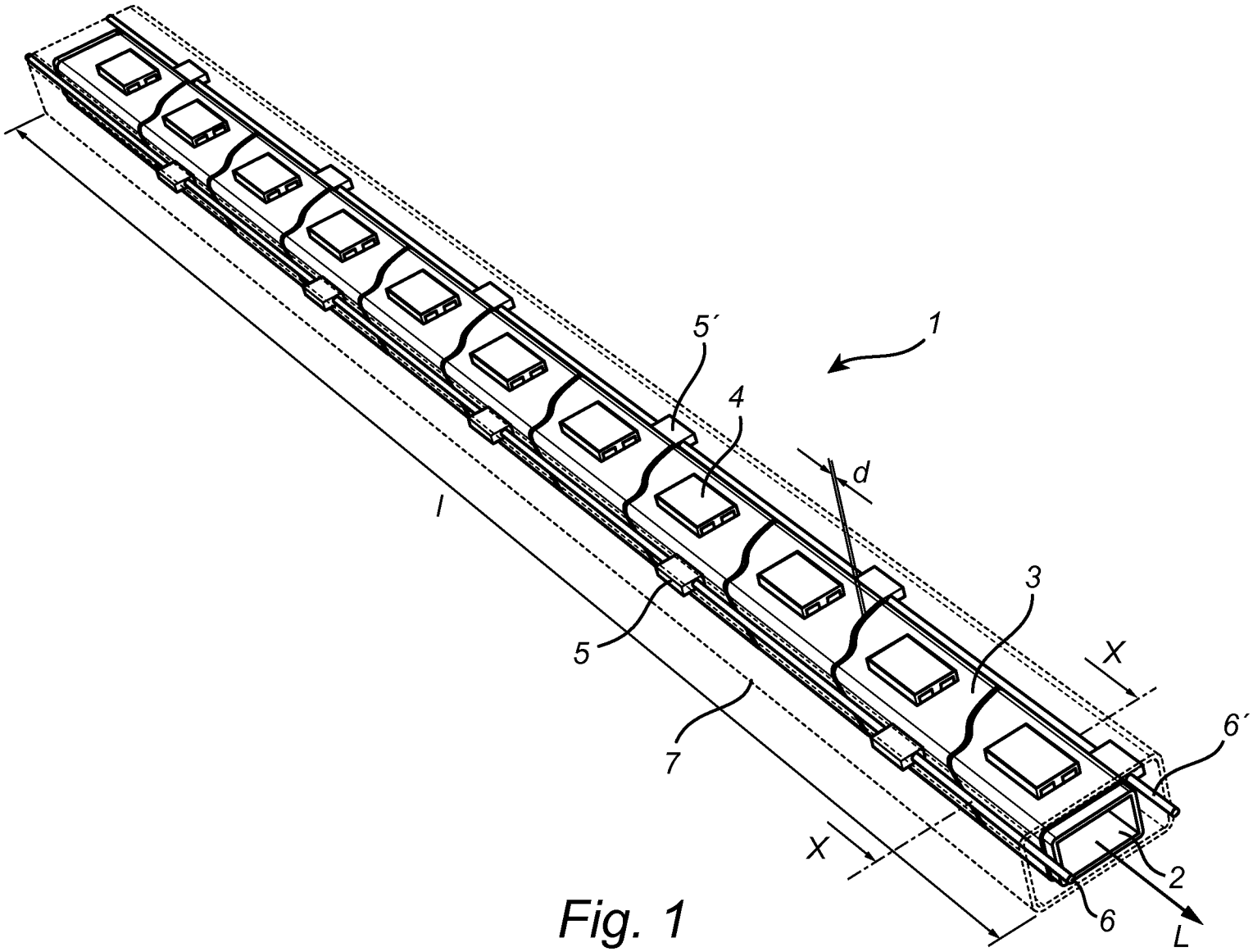
FIG. 1 shows a perspective view of a lighting device according to an embodiment of the invention.
Figure 2:
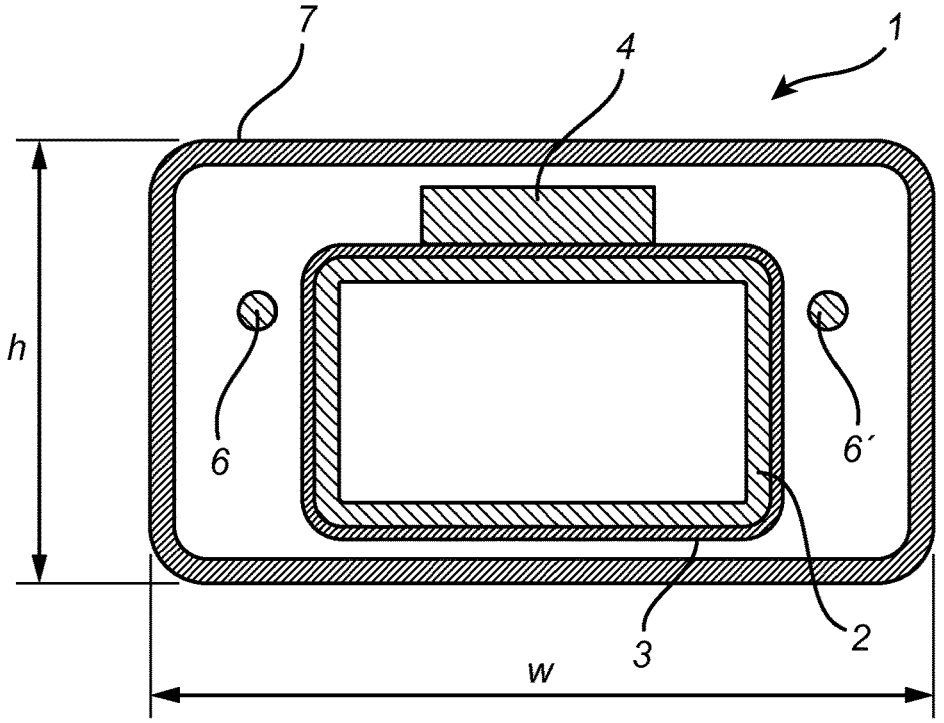
FIG. 2 shows a cross sectional view along line X-X in FIG. 1.

FIGS. 1 and 2 show a lighting device 1 which is suitable for use in applications such as, for example, cove lighting, wall washing, signage and architectural lighting. The lighting device 1 is elongated. In FIG. 1 the lighting device 1 is shown in a straight configuration and defines a longitudinal direction L. The length 1 of the lighting device 1 in the longitudinal direction depends on the application, but is typically in the range from 5 m to 10 m. The width w of the lighting device 1 is typically in the range from 10 mm to 20 mm, and the height h of the lighting device 1 is typically in the range from 10 mm to 15 mm.

The lighting device 1 has a central elongated flexible core 2, henceforth referred to as the "core" for brevity. The major extension of the core 2 is in the longitudinal direction L. The core 2 is capable of flexing in any direction perpendicular to the longitudinal direction L. Differently stated, the core 2 is bendable in any direction perpendicular to the longitudinal direction L. The core 2 is in this case made of a plastic material with a low modulus of elasticity and a high yield strength. The core 2 has the shape of a prism, more precisely a rectangular prism. The cross section of the core 1, transverse to the longitudinal direction L, is substantially rectangular, and the core 2 has four flat outer side surfaces extending in the longitudinal direction L. The side surfaces are pairwise oppositely arranged. The core 2 is a hollow tube and may thus be referred to as a core tube. In a different example the core 2 may be solid.

A flexible circuit strip 3, which may alternatively be referred to as a flexible circuit board, is wound around the core 2. The flexible circuit strip 3 will in the following be referred to as the "strip" for brevity. The strip 3 follows the contour of the core 2 in a helical path in the longitudinal direction. This means that the strip 3 has the shape of a helix, the axis of which is parallel with the longitudinal direction L. The strip 3 includes electrical circuitry for electrically connecting the SSL elements 4 (further discussed below). The strip 3 may for example be formed by a flexible plastic substrate on which a conductive pattern has been printed. Further, the strip 3 is wound around the core 2 so that there is a longitudinal gap, or space, between consecutive portions of the strip 3. The gap follows a helical path in the longitudinal direction L. The width d of the gap is typically in the range from 0.1 mm to 1 mm. The gap facilitates movement of the strip 3 during bending of the lighting device 1.

Several SSL elements 4 are mounted on and electrically connected to the strip 3. The SSL elements 4 are adapted to emit light. Each SSL element 4 includes one or more light sources, such as semiconductor LEDs, organic LEDs, polymer LEDs, or laser diodes. All of the SSL elements 4 may be configured to emit light of the same color, for example white light, or different SSL elements 4 may be configured to emit light of different colors. In the illustrated example, the SSL elements 4 are arranged in a row in the longitudinal direction L. It should be noted that even if the illustrated SSL elements 4 are aligned with each other, they could be arranged in for example a zigzag pattern in a different example. All of the SSL elements 4 are arranged along the same side of the core 2 (the top side in FIG. 1). Further, the SSL elements 4 are oriented so that, when the lighting device 1 is in the straight configuration illustrated in FIG. 1, all of the SSL elements 4 have the same general direction of illumination. The general direction of illumination is in this case perpendicular to the longitudinal direction L.

It should be noted that it is not necessary that all of the SSL elements 4 be oriented so as to emit light in the same general direction. In a different example (not shown), different SSL elements 4 may be oriented to emit light in different directions. For example, instead of all of the SSL elements 4 being positioned on the core's 2 top side, there may, alternatively or in addition, be SSL elements positioned on the core's 2 bottom side and/or lateral side(s). In this way the lighting device 1 may be adapted to emit light in two or more directions.

A first set of connectors 5 are mounted on the strip 3 and electrically connected to the SSL elements 4. In the illustrated example, the first set of connectors 5 are arranged in a row in the longitudinal direction L. The connectors 5 in the first set are aligned with each other. The first set of connectors 5 are arranged along a different side of the core 2 than the SSL elements 4, a lateral side in FIG. 1. The first set of connectors 5 may for example be SMT crimp contacts, like the Harwin S1721-06R. The connectors 5 in the first set are typically equidistantly arranged in the longitudinal direction L. The longitudinal distance between the connectors 5 in the first set may for example be in the range from 10 mm to 20 mm. The first set of connectors 5 are electrically connected to each other by a first wire 6 for providing electrical power to the SSL elements 4. The first wire 6 is in this case a main bus wire adapted to carry a current from an electric power supply, such as the mains electric power supply, via an LED driver (not shown).

A second set of connectors 5' are mounted on the strip 3 and electrically connected to the SSL elements 4. In the illustrated example, the second set of connectors 5' are arranged in a row in the longitudinal direction L. The connectors 5' in the second set are aligned with each other.

The second set of connectors 5' are arranged along a different side of the core 2 than the SSL elements 4 and the first set of connectors 5', a lateral side in FIG. 1. In the illustrated example the first set of connectors 5 and the second set of connectors 5' are arranged on opposite sides of the core 2. The connectors 5' in the second set are typically of the same type as the connectors 5 in the first set. For example, the connectors 5' in the second set may be SMT crimp contacts, like the Harwin S1721-06R. The connectors 5' in the second set of connectors are typically equidistantly arranged in the longitudinal direction L. The longitudinal distance between the connectors 5' in the second set may for example be in the range from 10 mm to 20 mm. The second set of connectors 5' are electrically connected to each other by a second wire 6' for providing electrical power to the SSL elements 4. The second wire 6' is in this case a main bus wire adapted to carry a current from an electric power supply, such as the mains electric power supply, via an LED driver (not shown).

It should be noted that several factors need to be taken into account when positioning the connectors 5, 5'. One such factor is "voltage drop" along the length 1 of the lighting device 1. One usually positions the connectors 5, 5' so as to eliminate, or at least reduce, voltage drop effects and, thereby, to ensure that the LEDs shine with substantially equal intensity. Further, the LEDs are typically grouped into parallel strings with the main bus, and the connectors 5, 5' are then usually placed at the points where the LED strings are connected to the main bus wires. Still further, where to best put the connectors 5, 5' may depend on the pitch of solder pads on the strip 3 and the diameter and the pitch of the helix. If the pitch and diameter are inaccurate, the error will accumulate and increase with the length of the helix, something which may result in misalignment of the connectors 5, 5' and the LEDs.

The lighting device 1 further comprises an outer housing 7. The housing 7 has a hollow tubular shape. The shape of the housing 7 may alternatively be referred to as hollow and cylindrical. Hence, the housing 7 has an interior space, and the core 2, the strip 3 with the SSL elements 4, the connectors 5, 5' and the wires 6, 6' are arranged in the interior space of the housing 7. These components are thus arranged inside the housing 7. The housing 7 is light-transmissive and flexible. In the illustrated example the housing 7 is capable of flexing in any direction perpendicular to the longitudinal direction L. Differently stated, the housing 7 is bendable in any direction perpendicular to the longitudinal direction L. The housing 7 is in this case made of a plastic material with a low modulus of elasticity and a high yield strength.

The lighting device 1 usually comprises additional components not shown in FIGS. 1 and 2, such as one or more drivers for the LEDs and end caps for connecting the lighting device 1 to a mains electric supply and/or to other lighting devices. The end caps may for example form a housing for the driver(s). The lighting device 1 is put in operation by connecting it to an electricity supply so that power is supplied to the SSL elements 4 via the driver(s), the wires 6, 6', the connectors 5, 5' and the strip 3. The SSL elements 4 emit light that is transmitted through the housing 7.

Figure 3:
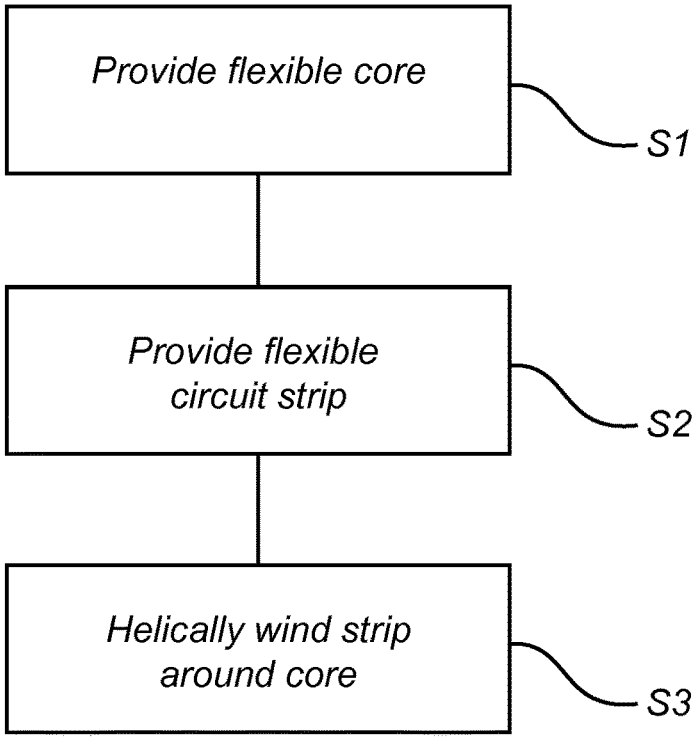
FIG. 3 shows a flowchart of a method for producing the lighting device in FIGS. 1 and 2.

The lighting device 1 may be produced by the method schematically illustrated in FIG. 3, i.e. by first, in steps S1 and S2, providing the core 2 and the strip 3 with the SSL elements 4, and then, in step S3, helically winding the strip 3 around the core 2. The SSL elements 4 of the illustrated lighting device 1 are positioned on the same side of the core 2, and this may be achieved by helically winding the strip 3 around the core 2 in the appropriate manner. The housing 7 may be formed by overmolding the strip 3 and the core 2. Alternatively, the housing 7 may be pre-formed separately, whereafter the strip 3 and the core 2 are inserted thereinto.

The person skilled in the art realizes that the present invention by no means is limited to the preferred embodiments described above. On the contrary, many modifications and variations are possible within the scope of the appended claims. For example, one of the first and second sets of connectors 5, 5' may be omitted.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A lighting device comprising:

an elongated flexible core having a polygonal transverse cross section; and a flexible circuit strip having several solid-state lighting elements mounted thereon, the flexible circuit strip being helically wound around the core, further comprising a first set of connectors mounted on the flexible circuit strip, said first set of connectors and the solid-state lighting elements are arranged on different sides of the core, the first set of connectors being adapted for electrically connecting the solid-state lighting elements to a power supply.

2. The lighting device according to claim 1, wherein the lighting device is bendable in at least two non-parallel directions.

3. The lighting device according to claim 1, wherein the core has a modulus of elasticity in the range from 0.001 GPa to 1 GPa, alternatively from 0.1 GPa to 1 GPa.

4. The lighting device according to claim 1, wherein the core has a yield strength in the range from 5 MPa to 50 MPa, alternatively from 25 MPa to 50 MPa.

5. The lighting device according to claim 1, wherein the core is made of a plastic material.

6. The lighting device according to claim 1, further comprising a flexible light-transmissive housing, the core and the flexible circuit strip being arranged inside the housing.

7. The lighting device according to claim 5, further comprising a wire electrically connecting the first set of connectors to each other, said wire extending along a side of the core where the first set of connectors are arranged.

8. The lighting device according to claim 5, further comprising a second set of connectors mounted on the flexible circuit strip, the second set of connectors being adapted for electrically connecting the solid-state lighting elements to a power supply and arranged on a different side of the core than the first set of connectors and the solid-state lighting elements.

9. The lighting device according to claim 8, further comprising a wire electrically connecting the second set of connectors to each other, said wire extending along a side of the core where the second set of connectors are arranged.

* * * * *